United States Patent [19]

Chase

[11] 3,959,536

[45] May 25, 1976

[54] KNOCK-DOWN ARTIFICIAL CHRISTMAS TREE

[75] Inventor: Ascher Chase, Virginia Beach, Va.

[73] Assignee: General Foam Plastics Corporation, Norfolk, Va.

[22] Filed: Nov. 27, 1974

[21] Appl. No.: 527,696

[52] U.S. Cl. ..... 428/8; 428/12; 428/20

[51] Int. Cl.[2] ..... A47G 33/06; A41G 1/00

[58] Field of Search ..... 161/13, 17, 24; 428/20, 428/8, 12

[56] References Cited

UNITED STATES PATENTS

| | | | |
|---|---|---|---|
| 1,555,621 | 9/1925 | Barker | 428/20 |
| 3,829,349 | 8/1974 | Hermanson | 428/8 |

FOREIGN PATENTS OR APPLICATIONS

| | | | |
|---|---|---|---|
| 874,704 | 8/1961 | United Kingdom | 428/20 |
| 843,220 | 8/1960 | United Kingdom | 428/20 |

*Primary Examiner*—Philip Dier
*Attorney, Agent, or Firm*—Mandeville and Schweitzer

[57] ABSTRACT

A knock-down artificial Christmas tree is provided utilizing a plurality of branch-retaining rings or holders for connecting the branches to the vertical support pole of the tree, alternating with spacers between those rings. The retaining rings and the spacers are comprised of, advantageously, molded thermoplastic, and the spacers are textured on the outer surfaces thereof to simulate the trunk of a tree, thus negating the necessity to wrap or hide, or otherwise mask an unsightly supporting pole for the tree. The branch-retaining rings, together with the alternating spacers, upon assembly of the tree, serve to place the branch-retaining rings and their associated branches in preselected, spaced fashsion along the trunk, to provide rapid assembly and disassembly of the tree. To impart a natural appearance, the branch-retaining rings are configured to accommodate differing numbers of branches in different areas of the tree. Moreover, the rings include means for holding the individual branches against rotation around their own axes or movement from their desired orientation. The positioning system herein provides for an "automatic" correct vertical spacing of the branches along the trunk, while the branch-retaining rings allow for correcting the circumferential or radial orientation of the branches around the tree.

7 Claims, 6 Drawing Figures

KNOCK-DOWN ARTIFICIAL CHRISTMAS TREE

STATEMENT OF THE INVENTION

Generally, this invention relates to artificial trees for use as a substitute for natural trees in decorating homes, terraces, patios, etc., and importantly, for use as Christmas trees. More particularly, this invention relates to an arrangement of elements which may be assembled by the purchaser in a rapid manner, to form the trunk and branches of a tree. The branches are automatically arranged vertically in the proper aesthetic relationship upon assembly, and with very minor further manual orientations circumferentially of the branches, as desired, the tree is fully erected. This is achieved by utilizing a plurality of alternating branch-retaining rings or holders in combination with spacers between the branch-retaining rings or holders, and with the spacers having an outer appearance which simulates the appearance of the bark of a natural tree trunk. The alternating spacers and branch-retaining rings are prenumbered to provide preselected positioning of the rings or holders and their associated branches along the vertical extent of the trunk of the tree.

The invention envisions and provides preassembly of the retaining rings with their associated branches, so that the consumer need only place the rings in the appropriate marked position along the trunk alternating with the spacers, to complete the assembly of the tree. It will be understood, of course, that the system herein also provides for the rapid disassembly of the tree for storage and/or movement to a different location.

BACKGROUND OF THE INVENTION

As will be understood, the use of artificial trees has increased rapidly over the last few years. The most significant commercial use is, of course, Christmas trees, although synthetic trees are being used in increasing numbers to decorate such areas as patios, porches and other areas of residences and commercial buildings. This rapid increase in use of such trees has been brought about for a number of reasons, including the development of a plurality of different resins which may be readily formulated economically into the proper configuration for such shapes as trees and/or plants, the increased cost of providing natural trees for such uses because of the length of time necessary to produce them and because of the cost of maintaining them in a proper and healthy state, together with increasing objections of ecologists in removing natural trees from their environment and/or destroying them after relatively short periods of use, such as, for example, when they are used for Christmas trees. Moreover, there is an increasing awareness of fire hazards, particularly in the use of Christmas trees, both for decoration in the home and in commercial establishments. With the development of thermoplastics, for example, which may be readily formulated or otherwise molded into parts for decorative or artificial trees, there has been a related development in the use of fire retardants in those plastics for inhibiting flame promulgation in artificial, decorative trees placed in a residence or public establishment.

Because of these factors, it is much safer, less costly, and less difficult for someone to purchase a knocked down, artificial tree, and to assemble it for use for the short period of time involved, and thereafter to store it and reuse it over a period of years. Moreover, many commercial establishments employ artificial trees on a large scale, both for use as Christmas trees, and as permanent decoration without incurring undue maintenance costs after their assembly and placement, and without requiring special precautions to comply with fire codes.

Many difficulties may arise, however, in the use of artificial trees, both with respect to general decorative ones and Christmas trees, in that the purchaser of such trees may not be dexterous or aesthetically inclined, while the trees heretofore available have required skill, patience and a degree of aesthetic inclination for arranging and assembling the branches to the trunk or supporting pole, to give a desired simulation of a natural tree. Attempts have been made to overcome these difficulties by such means as prenumbering or otherwise coding a plurality of bore holes drilled into the supporting trunk or pole, and in a similar manner, coding the branches, so that the assembly is properly coordinated. However, with these arrangements, after a period of use, the holes often tend to become enlarged and the branches have a tendency to rotate or otherwise become improperly oriented.

With respect to this latter problem, attempts have been made to overcome this by providing branch-retaining rings which are slid down along the trunk of the tree and spaced therealong for holding the individual branches. Whereas, these arrangements have served to provide for holding the branches in their proper orientation in the rings after they are placed there, these rings still require the assembler to select and insert the branches from a plurality of such branches, in order to arrange the tree in an appropriate fashion.

With this invention, by contrast, a plurality of retaining rings are provided for predetermined positioning in spaced relation along the vertical extent of a tree-supporting pole. The retaining rings are preselected to be positioned along the trunk in an assigned numbered or otherwise coded fashion. The retaining rings have a preselected number and size of branches, depending upon which portion of the tree is being assembled, in order to provide the appropriate shape and degree of foliage for that particular section of the tree. Cooperating in alternating fashion along the supporting pole of the tree are a plurality of spacers, in the form of tubular members of varying length, again preselected to be positioned along the trunk in an assigned numbered or otherwise coded fashion. Moreover, the spacers are textured and colored on the outer surfaces thereof to simulate the bark of a tree.

Thus, the assembler merely has to place the pole support for the tree in an appropriate base support, such as a conventional tripod base, read the identifying number on the lowermost position on the pole, select the appropriate spacer element which corresponds to that number and slip it down the pole to the bottom or lowermost portion of the supporting pole. Subsequently, the appropriately numbered branch retaining ring is selected and slipped down to be positioned on top of the spacer already positioned. Subsequently, alternating spacers and branch retaining rings are selected and slid down the supporting vertical pole. The assembly is completed by placement of a decorative branch on top of the supporting pole, with the total elapsed assembly time being a very few minutes at most. Of course, dismantling may be effected in the same very short period of time by reversing the assembly sequence.

Before describing this invention in more detail, it should be noted that a variety of different materials may be utilized for an artificial tree, produced in accordance herewith, including, for example, conventional twisted wire branches having tufted, intertwined plastic and/or metallic needles, twisted into place along the branches. Moreover, as will be understood, the branches may be single branches with no cross branches or they may have a plurality of cross branches, depending upon where the branches are to be placed on the tree, all in well known manner. The spacers forming the tree trunk may be cylindrical hollow structures and may be comprised of injection molded thermoplastic material, such as high impact polystyrene, or they may be metallic. Likewise, the retaining rings may be comprised of injection molded thermoplastic material.

Other objects and advantages of this invention will be apparent from the following description, the accompanying drawings, and the appended claims.

DESCRIPTION OF PREFERRED EMBODIMENT

Figure 1:
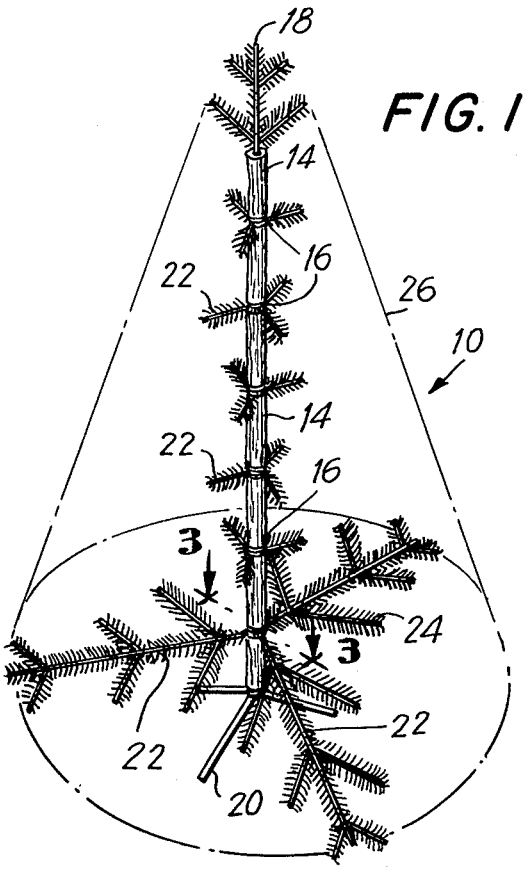
FIG. 1 is a diagrammatic, perspective view of an artificial tree, embodying the invention.

Referring to the drawings in which like reference characters refer to like parts throughout the several views thereof, an artificial Christmas tree is shown in FIG. 1, designated generally 10, having a vertical supporting pole 12 (FIG. 2) supported on a conventional tripod-type standard or base support 20. In this connection, it should be understood that it is within the purview of this invention to use any conventional type supporting pedestal, rather than the tripod-type shown. Arranged in spaced positions along pole 12 are a plurality of branches 22 supported thereon, to form an appropriately configured tree, such as a Christmas tree shown in outline as dotted line 26.

Disposed at the top of the tree 10 in an appropriate bore or other connection at the top of pole 12 is a top branch 18 to "top off" the general desired outline 26 of the tree. As can be seen in FIG. 1, spaced in alternating fashion along pole 12 and supported thereon, are a plurality of branch retaining rings 16 alternating with spacers 14. Moreover, as is apparent in FIG. 1, the spacers 14 are textured and roughened on the outer surfaces thereof to simulate a natural appearing tree trunk. While the one branch retaining ring shown with branches in FIG. 1 has only three branches, it is within the purview of this invention to have retainer rings with provisions for a larger or smaller number of branches at any one elevation along pole 12, in order to increase the amount of branches, as desired, to create a certain effect and to fill in the tree more densely in certain areas than in others, as will be understood. Furthermore, branches 22 may be in the form of a single branch with a plurality of cross branches 24, or the branches may be a single branch 22, again depending upon the required density in any particular area of the tree. Moreover, branches 22 may be longer or shorter to accommodate the desired outline of the tree, as will be understood.

Figure 3:
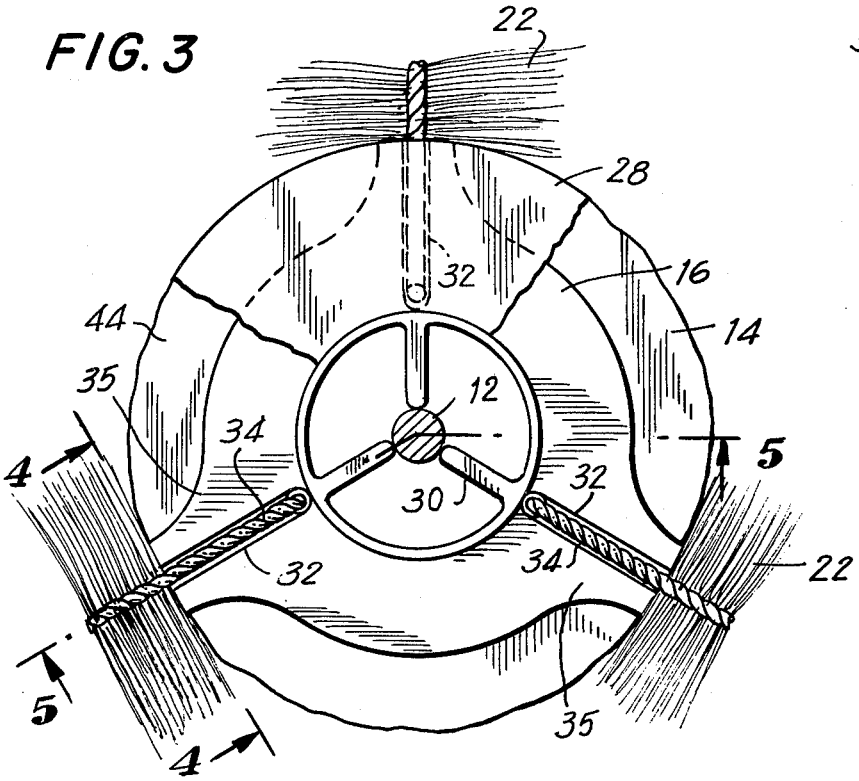
FIG. 3 is a cross sectional view taken along lines 3—3 of FIG. 1.
Figure 4:
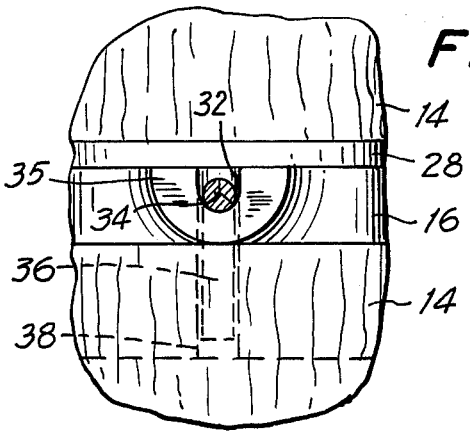
FIG. 4 is a cross sectional view taken along lines 4—4 of FIG. 3.
Figure 5:
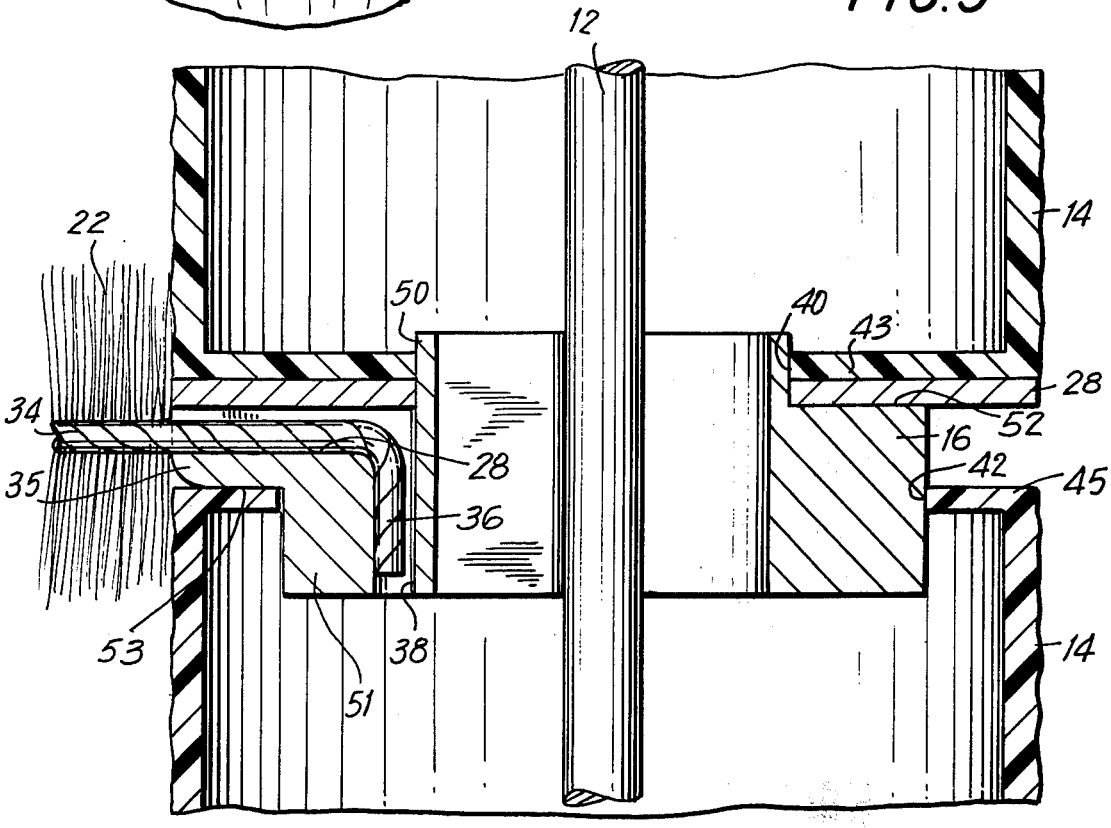
FIG. 5 is a cross sectional view taken along lines 5—5 of FIG. 3.

Referring now to FIG. 3, a retainer ring 16 is shown, having provision for supporting three branches 22. Retainer ring 16 has an extension 35 in position for supporting each branch 22, with each extension area 35 of retainer ring 16 having a troughlike semicircular bore 32 for supporting the inner portion 34 of a branch 22. As shown in FIG. 5, each trough 32 at the innermost extent thereof, has a vertically extending bore 38 for receiving the bent end 36 of a branch. With such a configuration, when a branch is received in trough 32 and bore 38, it will be held against relative rotation, so that it will be maintained in its desired position once the branch has been placed, as desired, in a retainer ring 16. As further shown in FIG. 3, each branch retainer ring 16 has a plurality of integral projections 30, which extend centrally thereof to form a generally circular opening for receiving the supporting pole 12 of the tree. In this connection, because of the projection 30 and because of the interconnection between rings 16 and spacers 14, discussed below, vertical pole 12 needs no separate provision on the surface thereof to support the parts therealong. As a consequence, pole 12 may be much less thick and lighter in weight, as well as simpler to produce.

The assembler, therefore, merely has to select the retainer rings with their associated branches in an appropriate numerical sequence, depending upon the sequence of numbers on the pole 12 and slip each retainer ring 16 over the end or top of the pole 12 to the appropriate numbered position on the pole 12. Subsequent to this positioning, the proper spacer 14 is then selected prior to the selection of an additional branch retaining ring for sliding over pole 12 and into position. The lowermost spacers 14 and alternating branch retainer rings 16 may be placed on pole 12 prior to erecting pole 12 on the base support 20, so that the lowermost branches may be slid from the bottom of pole 12 up and into place. Furthermore, in this connection, it is preferable for the branch retaining rings with their associated number of branches to be erected by the manufacturer so that the appropriate number of branches in any prenumbered retainer ring 16 are already positioned into place. Preferably, each retainer ring will have a retainer cap 28 placed thereon (FIG. 2) so as to maintain the prepositioned branches in place in the retainer rings during shipping and prior to erection of the artificial tree.

Figure 2:
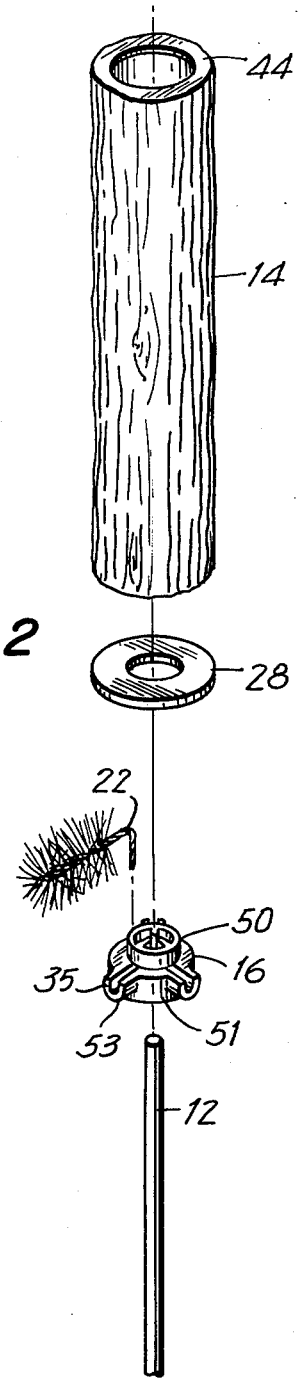
FIG. 2 is an exploded perspective view of the assembly sequence of branch retaining rings and spacers along the vertical supporting pole for the tree of the invention.

It should be understood, however, that it is within the purview of this invention to provide an artificial tree, in accordance herewith, in disassembled form with loose branches for selection by the assembler in a more personalized arrangement of artificial tree. The assembler, in such an arrangement, would, therefore, place the retainer cap 28 on pole 12 in the sequence as shown in FIG. 2.

Referring now to FIG. 5, a retainer ring 16 having a small diameter upper cylindrical bushing portion 50 and having a larger diameter lower cylindrical bushing portion 51, is shown placed on vertical supporting pole 12 between two spacers 14. The upper opening 42 of the cylindrical lower spacer 14, defined by a circular end wall 45, is smaller than the lower opening 40 of the cylindrical upper spacer 14 as viewed in FIG. 5. More specifically, the retainer ring 16 has an upper shoulder 52 upon which the cap 28 rests and which shoulder supports the lower end of a spacer 14, as will be understood. The bottom surfaces 53 of the extensions 35 form a lower shoulder which rests on the upper end wall 45 of the spacer 14. The combination of large and small spacer end openings and large and small retainer bushing portions ensures and simplifies the proper orientation of the spacers, holds the spacers appropriately in rigid association with the retainer rings, and maintains the spacers and retainers concentric with the pole 12.

Figure 6:
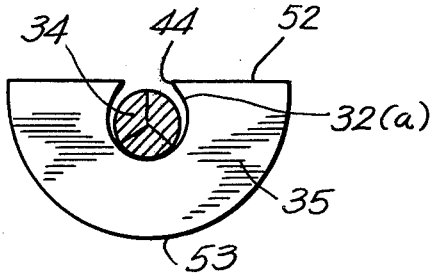
FIG. 6 is a cross sectional view similar to FIG. 4, showing a further embodiment or arrangement for holding the individual branches in the branch retainer rings of the invention assembly.

Referring now to FIG. 6, an alternative embodiment of trough 32a is shown in extensions 35 of retainer rings 16. That is, the upper opening 44 of troughs 32*a* in this embodiment are smaller than the diameter of innermost portions 34 of each branch 22. Thus, the innermost portions 34 of each branch 22 are pressfit into and through opening 44 into the troughs 32*a*. No separate retainer cap 28 is needed with this embodiment.

Thus, the tree, in accordance herewith, is assembled by placing the tree pole into a base support and then placing the first spacer on the pole and sliding it to the base. The appropriately numbered branch retaining ring with branches is then selected and placed on the pole with the large bushing portion 51 down, and slid to the top of the first spacer already in place, with the bushing 51 registering with and nesting in the opening 42. Thereafter, the second ring spacer is placed on the pole, with the small opening 40 down, and slid to the top of the first branch retaining ring and registered and nested with the upper bushing 50 of the retaining ring. This alternating process of stacking spacers 14 and rings 16 is repeated until the vertical pole 12 is full. Then the tree top is inserted in the pole to complete the tree.

Thus, as will be apparent from the foregoing, an extraordinarily rapid tree assembly is achieved. For example, with a six foot tree having eight branch groups, the assembly time is approximately three minutes or even less, as compared to a fifteen minutes or greater assembly time for a conventional artificial tree. Moreover, a much smaller diameter pole may be used, since no drilling or other configurations need be incorporated into the pole surface to hold the branches. Also, the branch groups may be rotated with respect to each other, to secure the best possible visual effect and "fullness". In addition, because of the nature of the support imparted to each branch by the branch retainer rings, in accordance herewith, wide tolerances may be employed and odd wire sizes may be utilized, which ordinarily cause difficulty with conventional artificial trees employing drilled holes. Thus, the manufacturing of the artificial tree assembly, in accordance herewith, is greatly facilitated. Moreover, because the spacers have the appearance of bark and resemble a tree trunk, the tree has a superior and natural look, and it is no longer necessary to provide a painted pole, tree wrap or short branch sections to hide an unsightly supporting pole.

As stated above, although the arrangment of retainer ring, in accordance herewith, includes the preinsertion and preselection of branches for each retainer ring prior to distribution to purchasers, it is within the purview of this invention that each retainer ring may be so distributed with a separate locking cap, so that the purchaser may, if he so desires, position the branches and select them as to size and length, to design a tree with his own desired configuration and appearance. Although this will entail an initial positioning by the assembler of the tree, once the assembler has placed the retainer rings and inserted the branches in the position which he desires, then he may apply the appropriate locking cap, so that his particular individualized arrangement will be maintained, whether or not the tree is knocked down and placed in storage, or whether or not he may desire to disassemble it and move it to a different location for subsequent erection into the very same configuration which he had previously.

Thus, as will be understood from the foregoing, there is provided in accordance herewith, an automatic, decorative tree assembly, in which the positioning of all the individual branches thereof may be preselected, so that the assembler merely has to place the prenumbered branch retaining rings at their appropriate preselected positions on the trunk, alternating with the appropriate preselected spacers to provide the desired aesthetic configuration of decorative tree. Because of the simplified configuration of parts and small number thereof, it will be understood that the decorative trees, in accordance herewith, may be produced from readily available thermoplastic materials utilizing mass production techniques. It will be appreciated, therefore, that the simplified construction herein may be utilized to produce artificial trees on a very economically attractive basis.

While the constructions herein described constitute preferred embodiments of the invention, it is to be understood that the invention is not limited to these precise constructions, and that changes may be made therein without departing from the scope of the invention, which is defined in the appended claims. For example, the bushing elements of the retainers and the mating openings in the spacers may be reversed, e.g., the male bushing elements on the retainers may be incorporated in the spacers and the female elements on the spacers may be incorporated into the retainers.

I claim:

1. An artificial tree assembly having a base support, and a tubular vertical support disposed upon said base support; said assembly comprising a. a plurality of branch retaining holders, each of said holders having axial bores for receiving said vertical support, the diameter of said bores being larger than the diameter of said vertical support;

b. a plurality of cylindrical spacer elements disposed along said vertical support in alternating fashion with said branch retaining holders, each of said spacer elements having an axial bore larger than the diameter of said vertical support;

c. means in said axial bores of said branch retaining holders for maintaining said holders concentric with said vertical support, said maintaining means being integral with said holders and extending toward but spaced from the axes of said bores; and d. cooperating means on said holders and said spacer elements for maintaining said spacer elements concentric with said vertical support.

2. An assembly as recited in claim 1, in which a. each of said plurality of holders has a plurality of circumferentially spaced integral branch retainers disposed therearound; and b. each of said branch retainers comprises a semicircular, substantially horizontal trough extending from the edge thereof toward the axis of said holder and a substantially vertical bore disposed at the inner end of said trough.

3. An assembly as recited in claim 1, in which a. each of said holders has preselectively arranged branches disposed thereon; and in which b. a branch retaining cap is disposed adjacent each holder for holding said branches in said preselectively arranged position.

4. An assembly as recited in claim 1, in which a. the outer surfaces of each of said spacer elements is textured and colored to resemble natural tree bark.

5. An assembly as recited in claim 1, in which a. said maintaining means includes a plurality of circumferentially spaced projections.

6. An assembly as recited in claim 1, in which a. said cooperating means includes openings in the bottom and top surface of each spacer element, said openings in the top surfaces being larger than the openings in the bottom surfaces for concentric engagement with adjacent surfaces of said holders.

7. An assembly as recited in claim 2, in which a. each of said troughs has an upper opening smaller than the diameter of branches to be received therein for press-fitting engagement of said branches.

* * * * *